US008365344B1

(12) United States Patent
Neu

(10) Patent No.: US 8,365,344 B1
(45) Date of Patent: Feb. 5, 2013

(54) GROOVE CLEANING TOOL

(76) Inventor: Kenneth Neu, Fort Myers, FL (US)

( * ) Notice: Subject to any disclaimer, the term of this patent is extended or adjusted under 35 U.S.C. 154(b) by 0 days.

(21) Appl. No.: 13/373,711

(22) Filed: Nov. 28, 2011

(51) Int. Cl.
*A47L 13/02* (2006.01)

(52) U.S. Cl. ..... 15/236.06; 15/236.01; 15/236.05; 15/236.07; 15/236.08

(58) Field of Classification Search ..... 15/236.01, 15/236.05, 236.06, 236.07, 236.08, 236.09; D21/795, 796
See application file for complete search history.

(56) References Cited

U.S. PATENT DOCUMENTS

| | | | | | |
|---|---|---|---|---|---|
| D193,679 | S | * | 9/1962 | Baldwin | D21/793 |
| D212,712 | S | * | 11/1968 | Godfrey | D21/793 |
| 3,763,515 | A | * | 10/1973 | Voss | 15/105 |
| D234,150 | S | * | 1/1975 | Yaudes | D21/793 |
| 3,994,040 | A | * | 11/1976 | DiStefano | 15/236.06 |
| 4,086,678 | A | * | 5/1978 | Torr | 15/105 |
| D306,060 | S | * | 2/1990 | Washburn | D21/793 |
| 4,908,899 | A | * | 3/1990 | Killen | 15/105 |
| 5,007,129 | A | * | 4/1991 | Hainey | 15/236.08 |
| 5,121,519 | A | * | 6/1992 | Haugom | 15/105 |
| 6,182,324 | B1 | * | 2/2001 | Pagliuzza et al. | 15/236.09 |
| 7,263,738 | B2 | * | 9/2007 | Moore | 15/111 |
| 7,621,819 | B1 | * | 11/2009 | Neu | 473/282 |
| 7,661,173 | B2 | * | 2/2010 | Amos | 15/142 |
| D613,806 | S | * | 4/2010 | Donaldson | D21/793 |
| 7,850,550 | B2 | * | 12/2010 | Nania et al. | 473/408 |
| 2010/0037412 | A1 | * | 2/2010 | Donaldson | 15/236.06 |
| 2011/0214242 | A1 | * | 9/2011 | Brown | 15/236.01 |

* cited by examiner

*Primary Examiner* — Randall Chin

(57) ABSTRACT

The tool provides for cleaning of debris from grooves positioned on a face of a golf club. The tool has at least one working set of groove penetration pins which extend from a face contact side of the tool. Each groove penetration pin of the working set utilized during a cleaning procedure seats within a respective groove of the golf club. Preferably each deployed working set has three groove penetration pins. Once the groove penetration pins of the utilized working set are seated in unique grooves the tool is moved along the face of the golf club where each groove penetration pin is displaced substantially along the length of the respective groove. This provides for at least a substantial portion of any debris within the groove under treatment to be removed from the grooves. A series of such swipes of the tool are employed to clean debris from all grooves.

20 Claims, 5 Drawing Sheets

FIG. 5
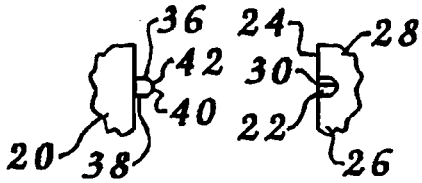
FIG. 4
FIG. 9
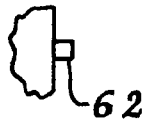
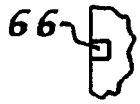
FIG. 10
FIG. 11
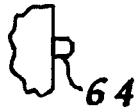
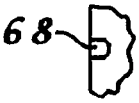
FIG. 12
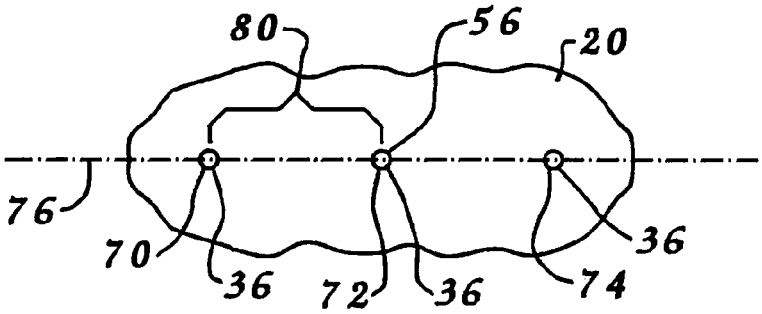
FIG. 13

GROOVE CLEANING TOOL

BACKGROUND

1. Field of the Invention

Generally, the invention relates to devices to clean debris from the grooves of a face of a head of a golf club. More specifically, the invention relates to such devices which clean debris from multiple grooves simultaneously.

2. Description of the Prior Art

Numerous methods exist to remove debris from grooves of a face of a head of a golf club which become deposited therein during play of the game of golf. The most common method utilized by golfers involves using the pointed end of a golf tee to individually scrap each groove having debris deposited therein. Following the scraping procedure the golfer typically follows up by wiping the club face with a cloth. This method of scraping grooves with a golf tee is time consuming and typically fails to leave the grooves free of debris to an acceptable level. This method of groove cleaning also tends to be less than uniform across all the grooves on a face of a golf club. This is due to wear to the tip of the golf tee being utilized for the cleaning. Golf tees typically are either formed from wood or plastic and the original tip normally does not match the width and shape of grooves where the tip will not fully seat within the grooves. Additionally, the user does not have any real guidance relative to the required pressure to apply during the movement of the golf tee along each respective groove other than experience and visual observations during the cleaning of the grooves of the golf club under treatment. For these reasons the cleaning process utilizing the golf tee does not typically produce the same level of cleaning from one cleaning procedure to another. This lack of uniformity of cleaning of the grooves of a particular golf club results in minor variations in outcome of strokes taken with that golf club during play of the game of golf.

Various devices have been proposed to provide for cleaning of debris from grooves of golf clubs. Most of these devices have a single tip which cleans a single groove during movement of the tip along each respective groove. Such devices have obvious advantages to use of the tip of a golf tee. First the material utilized to form the tip of the device can be durable and not subject to wear during usage where the tip retains its original shape for a prolonged period of time. Additionally the tip of the device can have a desired configuration which mates with a specific configuration of groove to be cleaned. This mating of the tip of the device to a specific groove configuration can generally match width, depth, configuration of the base of the groove and the configuration of the transition from the walls of the groove to the face of the golf club. This provides for a more uniform cleaning when the single tip groove cleaning device is utilized in an identical manner for all of the grooves on the golf club under treatment. Unfortunately, such single tip groove cleaning devices typically lack features to ensure that the same angle of placement of the tip within each of the grooves occur during movement of the device from one groove to another. This may result in a less than uniform cleaning operation to all of the groove having debris therein. Additionally, if the device is not held and retained at the proper angular orientation during movement of the tip from one end of the groove under treatment to the opposing end the device may actually damage the groove and change the configuration of the groove. Most of these devices lack features which prevent the tip from applying undue pressure to the base of the groove. This can result in damaging the base of the groove and either changing the cross section configuration or even in deepening the groove beyond the original specifications of the golf club. Additionally, such single tip groove cleaners only have a single tip configuration which mates with a single groove specification. Often golfers will have golf clubs having at least two unique groove configurations, such as one specification for their woods and one for their irons. In these instances the golfer utilizing a single tip groove cleaning device will not obtain optimum groove cleaning on all of his or her clubs. Additionally, single tip groove cleaning tools must be manipulated by the user along each groove to be cleaned. This individual swipe along each individual groove is time consuming and can be a distraction to the overall enjoyment derived from the game of golf. Additionally, such a time consuming procedure can result in the player not maintaining a desired level of cleanliness to the grooves of his or her clubs resulting in less than consistent performance during play of the game of golf.

Various deficiencies exist with the groove cleaning methods conventionally known and utilized during the play of golf. As can be seen various attempts have been made to provide for a golfer to maintain the grooves of his or her golf clubs in a debris free state where consistency of play may be obtained with each respective golf club having grooves positioned on the face of the club. These attempts have been less efficient than desired. As such, it may be appreciated that there continues to be a need for a groove cleaning tool which performs a consistent cleaning procedure to the grooves of a golf club while cleaning multiple grooves with each cleaning swipe of the tool across the face of the golf club. The present invention substantially fulfills these needs.

SUMMARY

In view of the foregoing disadvantages inherent in the known types of groove cleaning tools, your applicant has devised a groove cleaning tool to provide for performing a cleaning procedure on grooves positioned on a face of a head of a golf club to remove debris from the grooves. Such debris is routinely positioned on the face of the golf club and within the grooves positioned on the face of the golf club during play of the game of golf. Each of the grooves to be cleaned forms a linear trench in the face of the head of the golf club. The cleaning procedure utilizing the groove cleaning tool provides for a removal of at least a portion of debris deposited within the grooves during routine play of the game of golf. The groove cleaning tool has a body and a plurality of groove penetration pins. The body has a face contact side and an outer side. The face contact side makes contact with the face of the head of the golf club during the cleaning procedure performed on the grooves. The plurality of groove penetration pins are positioned within a working set with each groove penetration pin of the working set positioned within a separate groove during the cleaning procedure. The face contact side of the groove cleaning tool associated with the working set of groove penetration pins makes contact with the face of the golf club during at least a portion of the cleaning procedure. The face contact side of the groove cleaning tool associated with the working set of groove penetration pins ensures that the groove penetration pins of the working set seat to a proper depth within the grooves of the golf club and at a proper angular orientation to the grooves and the face of the golf club. The groove cleaning tool may have multiple working sets with unique characteristics. Each of the groove penetration pins of the working set extending outward from the face contact side of the body. Each groove penetration pin of the working set provides for a penetration of a respective groove in the face of the head of the golf club. Subsequent to such penetration, a movement along the respective groove provides for the respective groove penetration pin to encounter at least a portion of any debris positioned within the respective groove. This provides for a displacement of encountered debris for a removal of at least a portion of the encountered debris from the respective groove.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a groove cleaning tool which may be utilized to easily and consistently remove debris from grooves positioned on a face of a golf club where the grooves of the golf club can be maintained in a generally clean condition during play of the game of golf to enable consistent interaction between the golf club and a golf ball during play of the game of golf.

Other objects include;

a) to provide for a groove cleaning tool which operates on and clean multiple grooves positioned on the face of the golf club during each swiping pass of the groove cleaning tool during a cleaning procedure.

b) to provide for three groove penetration pins positioned in a working set to cooperate to remove debris from three grooves positioned on the face of the golf club during each of the swiping passes of the groove cleaning tool during the cleaning procedure.

c) to provide for the three groove penetration pins of the working set to seat in respective grooves to be treated with an untreated groove positioned between each adjacent pair of grooves to be treated during each of the swiping passes of the groove cleaning tool.

d) to provide for the three groove penetration pins of the working set to be axially rotated to fit within three grooves on a golf club to be treated where the golf club to be treated may be selected from golf clubs having variations in spacing between adjacent grooves.

e) to provide for deployment of multiple working sets of groove penetration pins on the groove cleaning tool with each deployed working set having unique configurations of groove penetration pins where the user may utilize the groove cleaning tool with golf clubs having unique configurations of grooves characteristics by selecting the applicable working set of groove penetration pins.

f) to provide for the groove penetration pins of a working set to have a predetermined length of extension from a face contact side of the groove cleaning tool where the groove penetration pins properly seat with grooves of a golf club with the face contact side of the groove cleaning tool in contact with the face of the golf club during each swiping pass where undue pressure can not be exerted by the respective groove penetration pins on a base of the respective grooves being cleaned where the potential for damage to the groove is minimized.

g) to provide for the groove penetration pins of a working set to have a predetermined diametric shape and a predetermined angular extension from the face contact side of the groove cleaning tool where the groove penetration pins properly seat with grooves of the golf club with the face contact side of the groove cleaning tool in contact with the face of the golf club during each swiping pass where undue pressure can not be exerted by the respective groove penetration pins on walls of the respective grooves being cleaned where the potential for damage to the groove is minimized.

h) to provide for multiple working sets of groove penetration pins to be deployed on the groove cleaning tool with each working set residing on a unique planar contract plane on the face contact side of the groove cleaning tool where only the groove penetration pins of the utilized working set make contact with any portion of the golf club during the cleaning procedure.

i) to provide for the groove cleaning tool to have an indentation on an outer side of the body of the groove cleaning tool for a comfortable and secure placement of the thumb of the user during retention of the groove cleaning tool by the user during performance of the cleaning procedure.

j) to provide for the groove cleaning tool to have a unique and separate indentation associated with a respective working set of groove penetration pins on the outer side of the body of the groove cleaning tool for a comfortable and secure placement of the thumb of the user during retention of the groove cleaning tool by the user during performance of the cleaning procedure utilizing the respective working set.

k) to provide for the groove cleaning tool to have an indentation on the face contact side of the body of the groove cleaning tool for a comfortable and secure placement of the index finger of the user during retention of the groove cleaning tool by the user during performance of the cleaning procedure.

l) to provide for markings on the outer side of the body of the groove cleaning tool to visually assist the user with proper placement of the groove penetration pins of the groove cleaning tool relative to the grooves of the golf club under treatment.

m) to provide for markings on the outer side of the body of the groove cleaning tool to visually assist the user with proper selection of an appropriate working set for use with a specific class of golf clubs.

n) to provide for a scraping edge having a sharp linearly aligned edge on the body of the groove cleaning tool to permit a swiping cleaning of the face of the golf club under treatment to remove debris positioned on the face of the golf club at any time during the cleaning procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 4 is an enlarged sectional view as taken from the section line '4' shown in FIG. 3.

FIG. 5 is an enlarged sectional view of a portion of the groove cleaning tool.

FIG. 9 is an enlarged sectional view of a portion of the groove cleaning tool.

FIG. 10 is an enlarged sectional view of a portion of a head of a class of golf club and showing a configuration of groove specific to that class.

FIG. 11 is an enlarged sectional view of a portion of the groove cleaning tool.

FIG. 12 is an enlarged sectional view of a portion of a head of a class of golf club and showing a configuration of groove specific to that class.

FIG. 13 is an enlarged bottom plan view of a sectional portion of the groove cleaning tool.

DESCRIPTION

Figure 1:
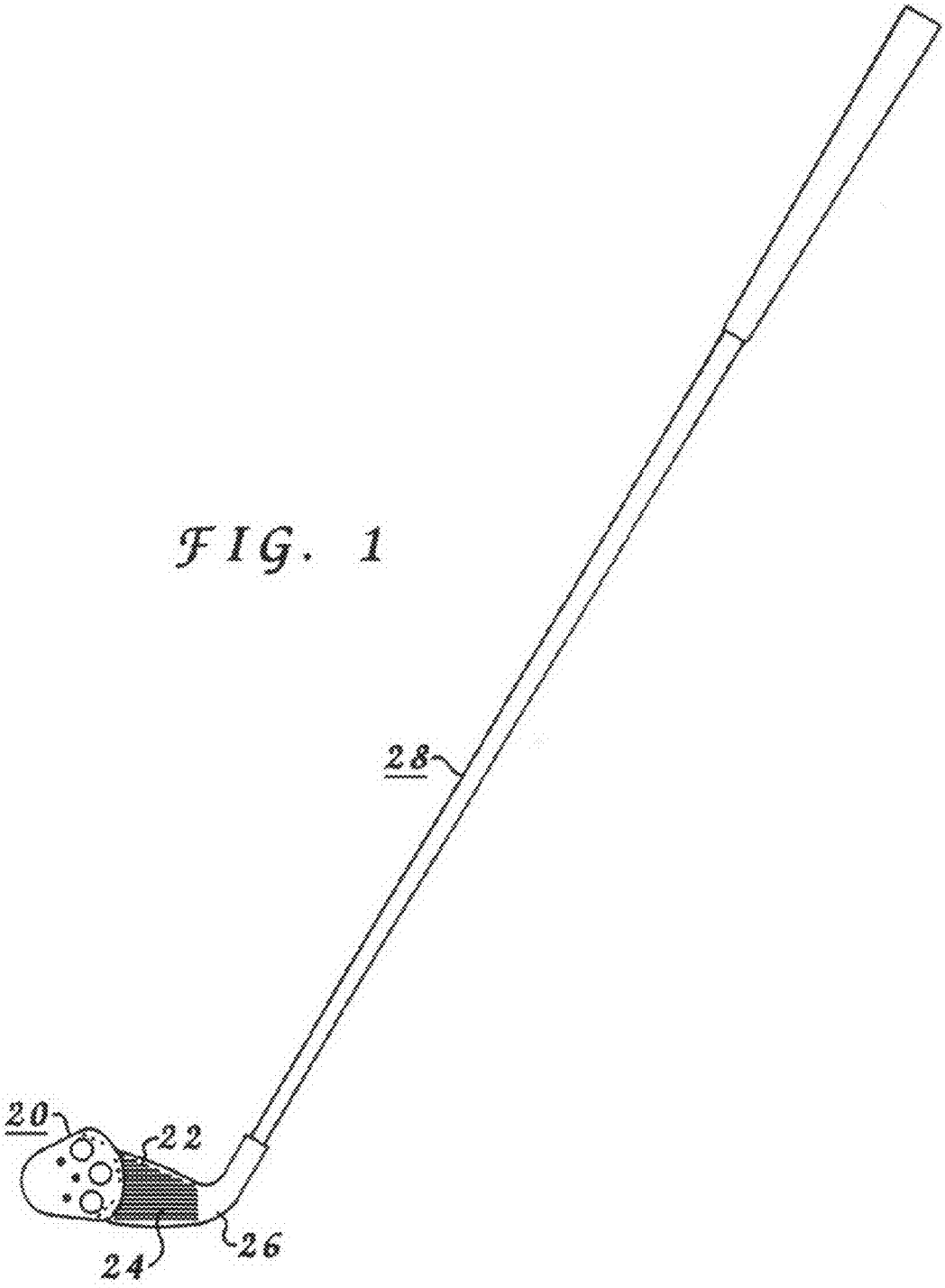
FIG. 1 is an elevational side view of a golf club and a groove cleaning tool.

Many different systems having features of the present invention are possible. The following description describes the preferred embodiment of select features of those systems and various combinations thereof. These features may be deployed in various combinations to arrive at various desired working configurations of systems.

Reference is hereafter made to the drawings where like reference numerals refer to like parts throughout the various views.

FIG. 1 depicts a groove cleaning tool 20 provides for performance of a cleaning procedure on grooves 22 positioned on a face 24 of a head 26 of a golf club 28. Golf club 28 is a workpiece upon which a groove cleaning tool having features of the present invention will operate. Golf club 28 forms no part of the invention. Applicable golf clubs will have a series of grooves extending across the face. Such grooves are known to have some desired effect upon a golf ball at the period of contact during striking of the golf ball. The United States Golf Association (USGA) and the Professional Golf Association (PGA) have rules and/or regulations governing play of the game of golf. These include restrictions regarding the configuration of golf equipment used during the play of golf. Most golfers routinely utilize only equipment, including golf clubs, which meet these regulations. Certain of these regulations govern various aspects of the grooves which may be utilized on the faces of golf clubs. The vast majority of commercial golf clubs which have such grooves remain within these limitations, such as for depth, width, bevel or chamfer of intersecting surfaces, spacing between grooves and placement on the face of the golf club. There still remains considerable variation in groove configuration available on golf clubs. The present invention provides various configurations of groove penetration pins, on a single tool in certain embodiments, which may be utilized on golf clubs having variation in groove configuration.

Figure 2:
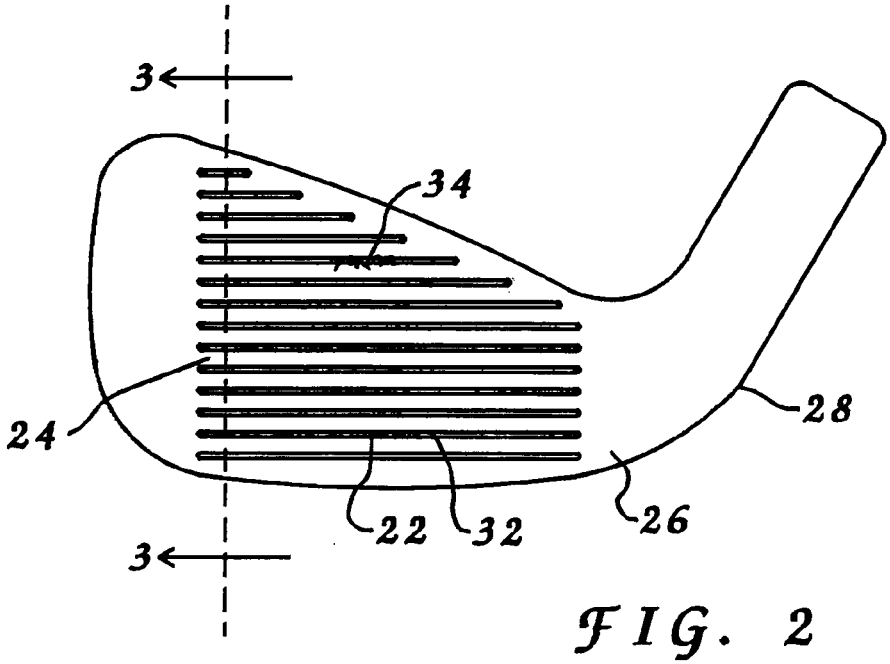
FIG. 2 is an enlarged elevational side view of a head of the golf club shown in FIG. 1.
Figure 3:
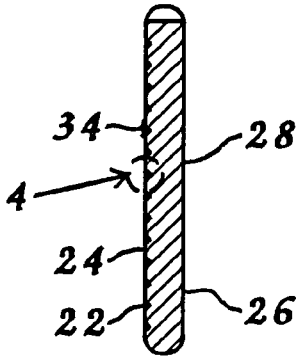
FIG. 3 is a sectional view as taken at the section line '3' shown in FIG. 2

FIG. 2 and FIG. 3 and FIG. 4 depict an example of groove 22 positioned on face 24 of head 26 of golf club 28. Groove 22 has a base 30 extending substantially along a length 32 of groove 22. It being understood that each deployed groove 22 may have a unique length and length 32 is utilized only as an example. Base 30 of groove 22 has a cross section configuration taken at a right angle to the length of the groove and depicted in FIG. 4. As clearly depicted in FIG. 2 grooves 22 of golf club 28 have a common linear alignment. The cleaning procedure utilizing a groove cleaning tool having features of the present invention provides for a removal of at least a portion of debris 34 deposited during routine play of the game of golf within grooves 22. Debris 34 is a workpiece upon which a groove cleaning tool having features of the present invention will operate.

Each groove penetration pin applicable to the present invention will have a shaft and a terminal end having a configuration which generally matches the cross section configuration of a compatible base of groove style. FIG. 5 depicts groove penetration pin 36 of groove cleaning tool 20 having a shaft 38 and a terminal end 40. Shaft 38 has a shape and a dimensional configuration. Terminal end 40 has a configuration 42 thereon having a unique shape and dimension.

Figure 6:
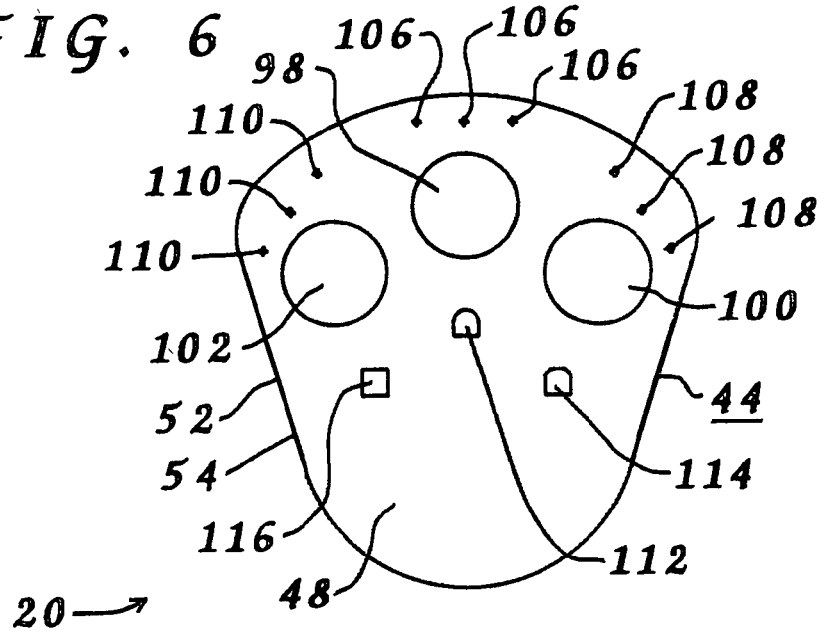
FIG. 6 is a plan top view of the groove cleaning tool.
Figure 7:
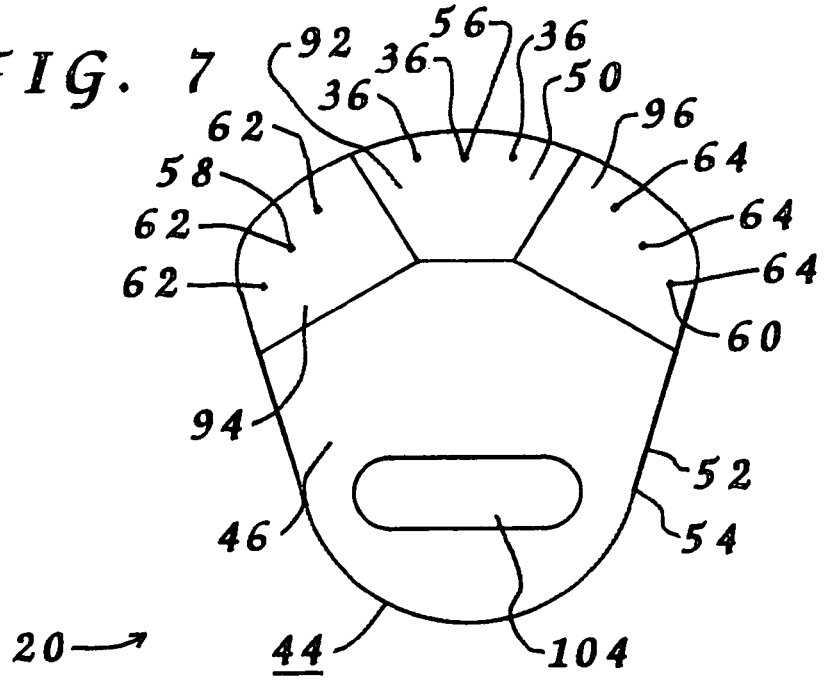
FIG. 7 is a plan bottom view of the groove cleaning tool shown in FIG. 6.

Groove cleaning tool 20 has a body 44, see FIG. 6 and FIG. 7, having a face contact side 46, see FIG. 7, and an outer side 48, see FIG. 6. Face contact side 46 makes contact with face 24 of head 26 of golf club 28 during the cleaning procedure performed on grooves 22, see FIG. 8*b*.

Referring now to FIG. 7, preferably face contact side 46 of body 44 in close proximity to groove penetration pins 36 will have a planar surface 50. This flat surface provides for an active engagement of face 24 of head 26 of golf club 28 during the cleaning procedure, see FIG. 8*b*. This arrangement provides for easy and ready alignment of groove cleaning tool 20 with face 24 of head 26 of golf club 28 during the cleaning procedure. This also ensures that each groove penetration pin 36 penetrates a respective groove to a desired predetermined depth and at a desired predetermined angular orientation to face 24 of head 26 of golf club 28 during the movement of groove cleaning tool 20 during the cleaning procedure.

Due to the accumulation of debris 34, see FIG. 1, on face 24 of head 26 of golf club 28 outside of grooves 22 it is desirable to initially remove such debris 34 prior to initiation of the cleaning procedure of grooves 22. Preferably such initial removal will not force the debris into the groove nor unduly compress debris positioned within the grooves. FIG. 6 and FIG. 7 depict body 44 having a scraping edge 52 having a generally sharp linearly aligned edge 54. Scraping edge 52 provides for user manipulated movement across face 24 of head 26 of golf club 28 to remove a portion of debris 34 positioned thereon, action not shown in the various views. While this face scraping procedure can occur at any time during the cleaning procedure, preferable it will occur at the start of the cleaning procedure to ensure proper seating of groove cleaning tool 20 relative to face 24 of head 26 of golf club 28 during the cleaning procedure performed on grooves 22.

The groove cleaning tool preferably will have at least one working set of groove penetration pins. Each working set will have at least two (2) groove penetration pins and most preferably each will have three (3) groove penetration pins. Utilization of three (3) groove penetration pins provides for use with various clubs having variations in spacing between adjacent grooves.

The embodiment of the present invention depicted has three (3) working sets 56, 58 and 60 with each working set 56, 58 and 60 having three unique sets of groove penetration pins 36, 62 and 64 respectively. Profiles of groove penetration pins 36, 62 and 64 are shown in FIG. 5, FIG. 9 and FIG. 11 respectively. As can be readily seen, each configuration of groove penetration pin 36, 62 and 64 are unique and designed to function most efficiently with a similarly configured style of groove 22, 66 and 68, shown in FIG. 4, FIG. 10 and FIG. 12 respectively.

Referring now to FIG. 13 first working set 56, as an example, has a first groove penetration pin 70, a second groove penetration pin 72 and a third groove penetration pin 74. First groove penetration pin 70, second groove penetration pin 72 and third groove penetration pin 74 are uniformly spaced and are aligned in a linear line 76.

Figure 8A:
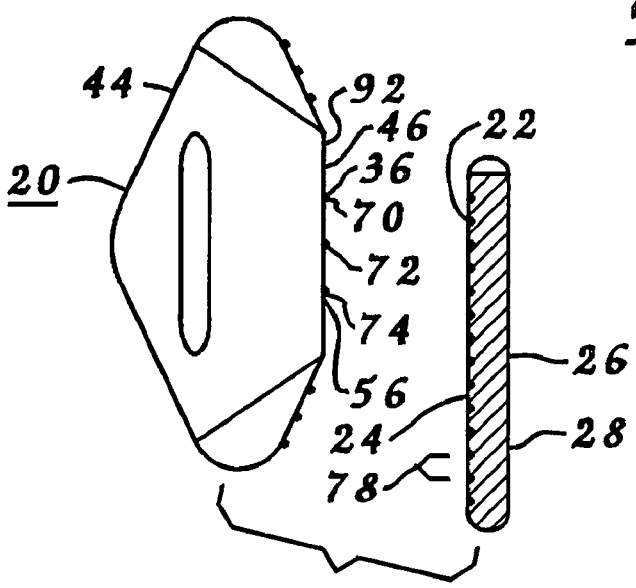
FIG. 8*a* and FIG. 8*b* are side elevational views of the groove cleaning tool positioned relative to an enlarged version of the sectional view of the head of the golf club shown in FIG. 3 in a spaced orientation and a contact orientation respectively.
Figure 8B:
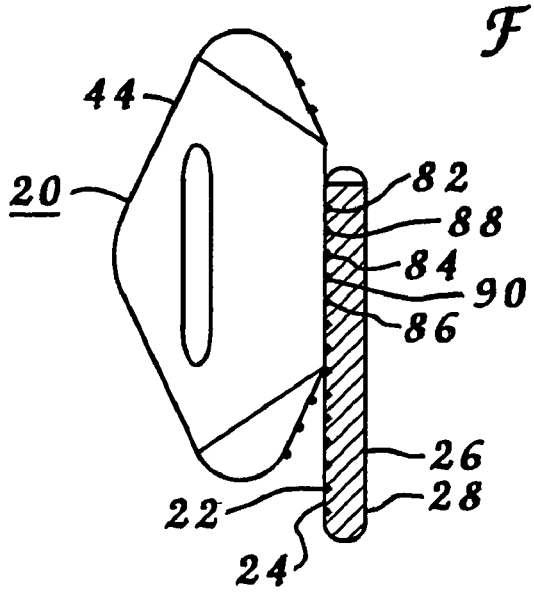

Without regard for the configuration of the groove penetration pin it will extend outward from body 44 from face contact side 46 where it may be inserted into an applicable groove on the face of the golf club subject to the cleaning procedure, see FIG. 8*a* and FIG. 8*b*. Three (3) groove penetration pins 36 of first working set 56 extending outward from face contact side 46 of body 44. Rotational manipulation of groove cleaning tool 20 provides for all three (3) groove penetration pins 36 to enter a separate respective groove 22 of golf club 28 without undue regard for the spacing of the adjacent grooves 22. While variation of spacing between adjacent grooves is common on golf clubs, typically the spacing between adjacent grooves on a golf club will be identical and uniformly spaced where the grooves are generally parallel.

Preferably the spacing between each adjacent pair of groove penetration pins will be identical where rotational manipulation of the groove cleaning tool will mate with the grooves when the grooves are arranged on the face of the golf club to be generally parallel to each other. Typically this will result in linear line 76 of groove penetration pins 36, 62 and 64 to be angularly offset relative to common linear alignment of grooves 22 positioned on face 24 of head 26 of golf club 28 during performance of the cleaning procedure.

FIG. 8*a* depicts a measurement of spacing 78 between adjacent grooves 22 positioned on face 24 of head 26 of golf club 28. FIG. 13 depicts a measurement of spacing 80 between adjacent groove penetration pins 36 in first working set 56 of groove cleaning tool 20. It being noted that measurement of spacing 80 of groove penetration pins 36 is greater than measurement of spacing 78 of grooves 22. It also being noted that measurement of spacing 80 of groove penetration pins 36 is at least twice measurement of spacing 78 between grooves 22. It also being noted that measurement of spacing 80 of groove penetration pins 36 is greater than twice measurement of spacing 78 between grooves 22. While it is possible to perform the cleaning procedure on adjacent grooves 22 during each movement of groove cleaning tool 20, preferably such cleaning procedure will occur with an untreated groove positioned between each adjacent pair of grooves 22 under treatment. This arrangement is desirable to prevent accumulation of debris which might adversely effect operation of groove cleaning tool 20.

FIG. 8*b* depicts a first groove penetration pin 70 positioned within a first groove under treatment 82 under treatment and a second groove penetration pin 72 positioned within a second groove under treatment 84 and a third groove penetration pin 74 positioned within a third groove under treatment 86. This arrangement places a first untreated groove 88 between first groove penetration pin 70 and second groove penetration pin 72 and a second untreated groove 90 between second groove penetration pin 72 and third groove penetration pin 74.

All working sets 56, 58 and 60 operate generally the same when matched to their respective configuration of groove style. Using first working set 56 as an example, groove cleaning tool 20 is manipulated by the user, conventionally known and not shown in any of the views, relative to face 24 of head 26 of golf club 28 until groove penetration pins 36 enter the desired three (3) grooves 22 of golf club 28, as depicted in FIG. 8*b*. Preferably this penetration occurs at one end of grooves 22. Once seated the user causes a movement of groove cleaning tool 20 along the length of grooves 22. This causes each respective groove penetration pin 36 to encounter at least a portion of any debris 34 positioned within the respective groove 22 to provide for a displacement of encountered debris 34 for a removal of at least a portion of the encountered debris 34 from the respective groove 22. This action will simultaneously remove debris 34 from three (3) grooves 22. If desired, the user may move groove cleaning tool 20 back and forth along grooves 22 as many times as desired. Following each cleaning procedure on three (3) grooves 22 the user will manipulate groove cleaning tool 20 to operate on untreated grooves 22 in sequence until all existing grooves 22 on golf club 28 have underwent the cleaning procedure.

Each working set of groove penetration pins will have a unique contact plane for mating with the face of the golf club during the cleaning procedure while utilizing each respective working set of groove penetration pins. FIG. 7 and FIG. 8*a* depict a contact plane 92 of first working set 56 of groove penetration pins 36. FIG. 8*a* depicts contact plane 92 spaced from face 24 of head 26 of golf club 28 prior to commencement of a swiping action of a cleaning procedure to subsequent to completion of a swiping action of the cleaning procedure. FIG. 8*b* depicts contact plane 92 in contact with face 24 of head 26 of golf club 28 as would occur during a swiping action of the cleaning procedure.

FIG. 7 also depicts a contact plane 94 of second working set 58 of groove penetration pins 62. Contact plane 94 is utilized as depicted for contact plane 92 of first working set 56 relative to face 24 of head 26 of golf club 28 to properly maintain contact, not shown, between groove cleaning tool 20 and face 24 during a cleaning procedure utilizing second working set 58. FIG. 7 also depicts a contact plane 96 of third working set 60 of groove penetration pins 64. Contact plane 96 is utilized as depicted for contact plane 92 of first working set 56 relative to face 24 of head 26 of golf club 28 to properly maintain contact, not shown, between groove cleaning tool 20 and face 24 during a cleaning procedure utilizing third working set 60.

As can readily be observed in FIG. 7 each contact plane 92, 94 and 96 is unique and offset from the remaining contact planes 92, 94 and 96. Alternatively it is possible to provide for a length of the groove penetration pins to be greater than the depth of the grooves applicable to those pins. While this is not preferred, it would provide for the surfaces of the groove cleaning tool immediately surrounding each groove penetration pin being utilized to be elevated above, and not in contact with, the face of the golf club under treatment during performance of the cleaning procedure.

As shown in FIG. 8*b*, groove penetration pins 62 and 64 of second working set 58 and third working set 60 respectively are elevated above and out of contact with face 24 of head 26 of golf club 28 subject to the cleaning procedure while groove penetration pins 36 of first working set 56 is being employed to perform the cleaning procedure. While not shown in the various views, groove penetration pins 36 and 64 of first working set 56 and third working set 60 respectively are elevated above and out of contact with face 24 of head 26 of golf club 28 subject to the cleaning procedure while groove penetration pins 62 of second working set 58 is being employed to perform the cleaning procedure. While not shown in the various views, groove penetration pins 36 and 62 of first working set 56 and second working set 58 respectively are elevated above and out of contact with face 24 of head 26 of golf club 28 subject to the cleaning procedure while groove penetration pins 64 of third working set 60 is being employed to perform the cleaning procedure.

It is preferred that some guidance be provided to the user to ensure proper thumb and finger placement during usage of groove cleaning tools having features of the present invention. FIG. 6 depicts a first indentation 98 positioned on outer side 48 of body 44 receives the thumb, conventionally known and not shown in any of the views, of the user during performance of the cleaning procedure while utilizing first working set 56. FIG. 6 also depicts a second indentation 100 positioned on outer side 48 of body 44 receives the thumb of the user during performance of the cleaning procedure while utilizing second working set 58. FIG. 6 also depicts a third indentation 102 positioned on outer side 48 of body 44 receives the thumb of the user during performance of the cleaning procedure while utilizing third working set 60. FIG. 7 depicts an indentation 104 positioned on face contact side 46 of body 44 to receive the index finger, or some other finger, of the user, conventionally known and not shown, during performance of the cleaning procedure. If desired separate indentations on face contact side 46 of body 44 may be provided and corresponding to utilization of separate working sets 56, 58 and 60.

FIG. 6 depicts various markings 106, 108 and 110 positioned on outer side 48 of body 44 indicative of a placement of groove penetration pins 36, 62 and 64 of working sets 56, 58 and 60 respectively on face contact side 46. Markings 106, 108 and 110 assist the user in orientation and use of groove cleaning tool 20 during the cleaning procedure. FIG. 6 also depict various markings 112, 114 and 116 positioned on outer side 48 of body 44 indicative of a configuration and characteristics of groove penetration pins 36, 62 and 64 respectively of working sets 56, 58 and 60 respectively. Markings 112, 114 and 116 assist the user in a selection of a proper working set 56, 58 or 60 for use with a specific class of golf club to receive the cleaning procedure. Markings 112, 114 and 116 each contain enlarged graphic representations of characteristics of a size and a shape of groove 22, 66 and 68 of the specific class of golf club.

It is possible to provide structures on groove cleaning tools having features of the present invention to actively divert debris. Examples include passageways through the body from the face contact side to the outer side and in close proximity to each groove penetration pin. Another example involves forming each applicable contact plane on the face contact side of the body for each working set to exist primarily ahead of the groove penetration pins where material displaced from the grooves of the golf club do not contact the groove cleaning tool. Numerous other configurations may be utilized.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A groove cleaning tool to provide for performing a cleaning procedure on grooves positioned on a face of a head of a golf club, each of the grooves forming a linear trench in the face of the head of the golf club, the cleaning procedure to provide for a removal of at least a portion of debris deposited within the grooves during routine play of the game of golf, the groove cleaning tool comprising:

a) a body having a face contact side and an outer side, the face contact side to make a contact with the face of the head of the golf club during the cleaning procedure performed on the grooves, and wherein the face contact side is a generally planar surface and the outer side is a generally expansive surface and wherein the face contact side and the outer side generally face one another;

b) a plurality of groove penetration pins positioned within a working set, each of the groove penetration pins of the working set extending outward from the face contact side of the body, each groove penetration pin of the working set to provide for a penetration of a respective groove in the face of the head of the golf club and a movement along the respective groove wherein the respective groove penetration pin encounters at least a portion of any debris positioned within the respective groove to provide for a displacement of encountered debris for a removal of at least a portion of the encountered debris from the respective groove.

2. The groove cleaning tool defined in claim 1 wherein the working set of groove penetration pins further comprise a first groove penetration pin and a second groove penetration pin.

3. The groove cleaning tool defined in claim 1 wherein the working set of groove penetration pins further comprise a first groove penetration pin and a second groove penetration pin and a third groove penetration pin.

4. The groove cleaning tool defined in claim 1 wherein each set of adjacent grooves of the grooves positioned on the face of the head of the golf club are generally parallel with a generally uniform spacing between each of the sets of adjacent grooves with each of the sets of adjacent grooves having a measurement of spacing therebetween, and wherein each adjacent set of groove penetration pins has a measurement of spacing and wherein the measurement of spacing between adjacent sets of groove penetration pins is greater than the measurement of spacing between adjacent grooves positioned on the face of the head of the golf club.

5. The groove cleaning tool defined in claim 1 wherein each set of adjacent grooves of the grooves positioned on the face of the head of the golf club are generally parallel with a generally uniform spacing between each of the sets of adjacent grooves with each of the sets of adjacent grooves having a generally uniform measurement of spacing therebetween, and wherein each adjacent set of groove penetration pins has a measurement of spacing therebetween and wherein the measurement of spacing between adjacent sets of groove penetration pins is at least twice the measurement of spacing between adjacent grooves positioned on the face of the head of the golf club.

6. The groove cleaning tool defined in claim 1 wherein each groove positioned on the face of the head of the golf club has a base extending substantially along a length of the groove and wherein the base of each groove has a cross section configuration taken at a right angle to the length of the groove and wherein each groove penetration pin has a terminal end and wherein the terminal end of each groove penetration pin has a configuration which generally matches the cross section configuration of the base of each groove positioned on the face of the head of the golf club.

7. The groove cleaning tool defined in claim 1 wherein the face contact side of the body in close proximity to the groove penetration pins of the working set has a planar surface to provide for an active engagement of the face of the head of the golf club during the cleaning procedure wherein each respective groove penetration pin of the working set penetrates a respective groove to a predetermined depth and at a predetermined angular orientation to the face of the head of the golf club during the movement of the cleaning procedure.

8. The groove cleaning tool defined in claim 1 wherein the body further comprises a scraping edge having a generally sharp linearly aligned edge, the scraping edge to provide for a movement across the face of the head of the golf club to remove a portion of debris positioned thereon during the cleaning procedure.

9. The groove cleaning tool defined in claim 1 wherein each set of adjacent grooves of the grooves positioned on the face of the head of the golf club are generally parallel with a generally uniform spacing between each of the sets of adjacent grooves with each of the sets of adjacent grooves having a generally uniform measurement of spacing therebetween, and wherein the working set of groove penetration pins further comprise a first groove penetration pin and a second groove penetration pin and a third groove penetration pin, and wherein each adjacent set of groove penetration pins has a measurement of spacing therebetween and wherein the measurement of spacing between adjacent sets of groove penetration pins is greater than twice the measurement of spacing between adjacent grooves positioned on the face of the head of the golf club and wherein the first, second and third groove penetration pins operate on respective grooves with a first untreated groove on the face of the head of the golf club positioned between the first groove penetration pin and the second groove penetration pin and with a second untreated groove on the face of the head of the golf club positioned between the second groove penetration pin and the third groove penetration pin.

10. The groove cleaning tool defined in claim 1 wherein the grooves positioned on the face of the head of the golf club have a common linear alignment and wherein the working set of groove penetration pins further comprise a first groove penetration pin and a second groove penetration pin and a third groove penetration pin, and wherein the first, second and third groove penetration pins are aligned in a linear line and wherein the linear line of the groove penetration pins are angularly offset relative to the linear alignment of the grooves positioned on the face of the head of the golf club during performance of the cleaning procedure.

11. A groove cleaning tool to provide for performing a cleaning procedure on grooves positioned on a face of a head of a golf club, each of the grooves forming a linear trench in the face of the head of the golf club, each groove positioned on the face of the head of the golf club having a base extending substantially along a length of the groove and wherein the base of each groove has a cross section configuration taken at a right angle to the length of the groove, the cleaning procedure to provide for a removal of at least a portion of debris deposited within the grooves during routine play of the game of golf, the groove cleaning tool comprising:

a) a body having a face contact side and an outer side, the face contact side to make a contact with the face of the head of the golf club during the cleaning procedure performed on the grooves, and wherein the face contact side is a generally planar surface and the outer side is a generally expansive surface and wherein the face contact side and the outer side generally face one another;

b) a first working set having a plurality of groove penetration pins, each of the groove penetration pins of the first working set extending outward from the face contact side of the body, and wherein each groove penetration pin of the first working set has a terminal end and wherein the terminal end of each groove penetration pin of the first set has a first configuration which generally matches the cross section configuration of the base of each groove positioned on the face of the head of the golf club of a first class of golf clubs, each groove penetration pin of the first working set to provide for a penetration of a respective groove in the face of the head of the golf club of the first class of golf clubs and a movement along the respective groove wherein the respective groove penetration pin encounters at least a portion of any debris positioned within the respective groove to provide for a displacement of encountered debris for a removal of at least a portion of the encountered debris from the respective groove, the first working set of groove penetration pins to residing on a contact plane;

c) a second working set having a plurality of groove penetration pins, each of the groove penetration pins of the second working set extending outward from the face contact side of the body, and wherein each groove penetration pin of the second working set has a terminal end and wherein the terminal end of each groove penetration pin of the second set has a second configuration which generally matches the cross section configuration of the base of each groove positioned on the face of the head of the golf club of a second class of golf clubs, each groove penetration pin of the second working set to provide for a penetration of a respective groove in the face of the head of the golf club of the second class of golf clubs and a movement along the respective groove wherein the respective groove penetration pin encounters at least a portion of any debris positioned within the respective groove to provide for a displacement of encountered debris for a removal of at least a portion of the encountered debris from the respective groove, the second working set of groove penetration pins to residing on a contact plane;

and wherein the contact plane of the first working set of groove penetration pins is unique and offset from the contact plane of the second working set of groove penetration pins wherein when the first working set of groove penetration pins are utilized during the cleaning procedure on the grooves the second working set of groove penetration pins is elevated above and out of contact with the face of the head of the golf club subject to the cleaning procedure on the grooves and wherein when the second working set of groove penetration pins are utilized during the cleaning procedure on the grooves the first working set of groove penetration pins is elevated above and out of contact with the face of the head of the golf club subject to the cleaning procedure on the grooves.

12. The groove cleaning tool defined in claim 11 wherein the first working set of groove penetration pins further comprise a first groove penetration pin and a second groove penetration pin and a third groove penetration pin and wherein the second working set of groove penetration pins further comprise a first groove penetration pin and a second groove penetration pin and a third groove penetration pin.

13. The groove cleaning tool defined in claim 11 further comprising a third working set having a plurality of groove penetration pins, each of the groove penetration pins of the third working set extending outward from the face contact side of the body, and wherein each groove penetration pin of the third working set has a terminal end and wherein the terminal end of each groove penetration pin of the third set has a third configuration which generally matches the cross section configuration of the base of each groove positioned on the face of the head of the golf club of a third class of golf clubs, each groove penetration pin of the third working set to provide for a penetration of a respective groove in the face of the head of the golf club of the third class of golf clubs and a movement along the respective groove wherein the respective groove penetration pin encounters at least a portion of any debris positioned within the respective groove to provide for a displacement of encountered debris for a removal of at least a portion of the encountered debris from the respective groove, the third working set of groove penetration pins to residing on a contact plane;

and wherein the contact plane of the third working set of groove penetration pins is unique and offset from the contact plane of the first working set of groove penetration pins and is unique and offset from the contact plane of the second working set of groove penetration pins wherein when the third working set of groove penetration pins are utilized during the cleaning procedure on the grooves the first working set of groove penetration pins is elevated above and out of contact with the face of the head of the golf club subject to the cleaning procedure on the grooves and wherein when the third working set of groove penetration pins are utilized during the cleaning procedure on the grooves the second working set of groove penetration pins is elevated above and out of contact with the face of the head of the golf club subject to the cleaning procedure on the grooves.

14. The groove cleaning tool defined in claim 11 further comprising a first indentation positioned on the outer side of the body to receive the thumb of the user during performance of the cleaning procedure.

15. The groove cleaning tool defined in claim 14 further comprising a second indentation positioned on the outer side of the body to receive the thumb of the user during performance of the cleaning procedure and wherein the first indentation on the outer side of the body is utilized when the first working set of groove penetration pins are utilized during the cleaning procedure and the second indentation on the outer side of the body is utilized when the second working set of groove penetration pins are utilized during the cleaning procedure.

16. The groove cleaning tool defined in claim 11 further comprising an indentation positioned on the face contact side of the body to receive the index finger of the user during performance of the cleaning procedure.

17. The groove cleaning tool defined in claim 11 further comprising markings positioned on the outer side of the body indicative of a placement of the groove penetration pins of the first working set and of the second working set to assist the user in orientation and use of the groove cleaning tool during the cleaning procedure.

18. The groove cleaning tool defined in claim 11 further comprising markings positioned on the outer side of the body indicative of a configuration and characteristics of the groove penetration pins of the first working set and of the second working set to assist the user in a selection of a proper working set for use with a specific class of golf club to receive the cleaning procedure.

19. The groove cleaning tool defined in claim 18 wherein the markings indicative of the configuration and characteristics of the groove penetration pins further comprise graphic representations of characteristics of a size and a shape of the groove of the specific class of golf club.

20. The groove cleaning tool defined in claim 11 wherein each set of adjacent grooves of the grooves positioned on the face of the head of the golf club are generally parallel with a generally uniform spacing between each of the sets of adjacent grooves with each of the sets of adjacent grooves having a generally uniform measurement of spacing therebetween, and wherein each of the working sets of groove penetration pins further comprise a first groove penetration pin and a second groove penetration pin and a third groove penetration pin, and wherein each adjacent set of groove penetration pins of each working set has a measurement of spacing therebetween and wherein the measurement of spacing between adjacent sets of groove penetration pins is greater than twice the measurement of spacing between adjacent grooves positioned on the face of the head of the golf club and wherein the first, second and third groove penetration pins of each respective working set operate on respective grooves with a first untreated groove on the face of the head of the golf club positioned between the first groove penetration pin and the second groove penetration pin and with a second untreated groove on the face of the head of the golf club positioned between the second groove penetration pin and the third groove penetration pin.

* * * * *